US008458822B2

(12) United States Patent
Lee

(10) Patent No.: US 8,458,822 B2
(45) Date of Patent: Jun. 11, 2013

(54) HELMET

(75) Inventor: Seoung-Woo Lee, Seoul (KR)

(73) Assignees: Seoung-Woo Lee (KR); KIDO Sports Co., Ltd. (KR)

( * ) Notice: Subject to any disclaimer, the term of this patent is extended or adjusted under 35 U.S.C. 154(b) by 799 days.

(21) Appl. No.: 12/442,078

(22) PCT Filed: Sep. 20, 2007

(86) PCT No.: PCT/KR2007/004581

§ 371 (c)(1),
(2), (4) Date: Sep. 17, 2009

(87) PCT Pub. No.: WO2008/035927

PCT Pub. Date: Mar. 27, 2008

(65) Prior Publication Data

US 2010/0005558 A1 Jan. 14, 2010

(30) Foreign Application Priority Data

Sep. 21, 2006 (KR) ..... 10-2006-0091981

(51) Int. Cl.
*A42B 1/08* (2006.01)
*A42B 1/24* (2006.01)
*A63B 71/10* (2006.01)

(52) U.S. Cl.
USPC ..... 2/424; 2/422; 2/425

(58) Field of Classification Search
USPC ..... 2/410, 6.3, 6.5, 6.7, 422, 424, 425, 2/15, 10, 9, 427, 443; D29/104, 105, 106, D29/107
See application file for complete search history.

(56) References Cited

U.S. PATENT DOCUMENTS

| | | | | |
|---|---|---|---|---|
| 3,383,706 | A * | 5/1968 | Lobelle | 2/6.5 |
| 3,473,166 | A * | 10/1969 | Lobelle | 2/6.5 |
| 3,631,540 | A * | 1/1972 | Penny | 2/410 |
| 4,199,823 | A * | 4/1980 | Jenkins et al. | 2/424 |
| 4,292,688 | A * | 10/1981 | Ellis | 2/6.4 |
| 4,397,047 | A * | 8/1983 | Nava | 2/424 |
| 4,559,679 | A * | 12/1985 | Downey | 24/615 |

(Continued)

FOREIGN PATENT DOCUMENTS

| | | | |
|---|---|---|---|
| FR | 2593036 | A1 * | 7/1987 |
| GB | 2024000 | A | 1/1980 |

(Continued)

OTHER PUBLICATIONS

English Machine Translation of French Patent FR 2593036; Inventor: Landi Cesare; 3 pgs. total.*

*Primary Examiner* — Shelley Self
*Assistant Examiner* — Jane Yoon
(74) *Attorney, Agent, or Firm* — Park & Associates IP Law, P.C.

(57) ABSTRACT

The present invention provides a helmet that is convenient in use. The helmet of the present invention includes a main body defining a space receiving a head of a wearer, a holder that is elastically coupled to the main body to be capable of pivoting and has a pushing member, a shield that is detachably coupled to the holder so that the wearer can securely obtain a viewing field, and a locking/unlocking unit that maintains or releases an open state of the holder when the holder pivots to the open state. The helmet structure as above can open and close the face shield by simply pushing the shield upward.

7 Claims, 9 Drawing Sheets

U.S. PATENT DOCUMENTS

| | | | | | |
|---|---|---|---|---|---|
| 4,571,747 | A | * | 2/1986 | Briggs | 2/424 |
| 4,581,776 | A | * | 4/1986 | Kie | 2/425 |
| 4,689,836 | A | * | 9/1987 | Vitaloni | 2/424 |
| 4,769,857 | A | * | 9/1988 | Cianfanelli et al. | 2/424 |
| 4,866,792 | A | * | 9/1989 | Arai | 2/424 |
| 4,926,854 | A | * | 5/1990 | Bode | 128/201.23 |
| 5,177,816 | A | * | 1/1993 | Schmidt et al. | 2/424 |
| 5,182,816 | A | * | 2/1993 | Arai | 2/424 |
| 5,185,889 | A | * | 2/1993 | Kamata | 2/424 |
| 5,329,642 | A | * | 7/1994 | Dampney | 2/424 |
| 5,333,329 | A | * | 8/1994 | Hong | 2/424 |
| 5,444,875 | A | * | 8/1995 | Taniuchi | 2/424 |
| 5,671,483 | A | * | 9/1997 | Reuber | 2/424 |
| 5,813,048 | A | * | 9/1998 | Thom | 2/6.5 |
| 5,890,233 | A | * | 4/1999 | Kaffka | 2/424 |
| 5,987,651 | A | | 11/1999 | Tanaka | |
| 5,987,652 | A | * | 11/1999 | Fowler | 2/424 |
| 6,047,409 | A | * | 4/2000 | Simpson | 2/424 |
| 6,161,225 | A | * | 12/2000 | Arai | 2/424 |
| 6,182,298 | B1 | * | 2/2001 | Dampney | 2/422 |
| 6,226,803 | B1 | * | 5/2001 | Tanaka | 2/424 |
| 6,260,213 | B1 | * | 7/2001 | Eom et al. | 2/424 |
| 6,282,726 | B1 | * | 9/2001 | Noyerie et al. | 2/6.5 |
| 6,301,719 | B1 | * | 10/2001 | Goodhand et al. | 2/422 |
| 6,557,185 | B1 | * | 5/2003 | Lee | 2/424 |
| 6,622,313 | B1 | * | 9/2003 | Choi et al. | 2/424 |
| 7,207,072 | B2 | * | 4/2007 | Halsnes et al. | 2/424 |
| 7,210,174 | B2 | * | 5/2007 | Yeh | 2/424 |
| 7,398,561 | B2 | * | 7/2008 | Kim et al. | 2/424 |
| 7,546,645 | B2 | * | 6/2009 | Goodhand et al. | 2/424 |
| 7,841,026 | B2 | * | 11/2010 | Makris et al. | 2/424 |
| 8,069,499 | B2 | * | 12/2011 | Isobe | 2/424 |
| 2003/0182716 | A1 | * | 10/2003 | Wu | 2/424 |
| 2003/0182717 | A1 | * | 10/2003 | Choi et al. | 2/424 |
| 2003/0196255 | A1 | * | 10/2003 | Arai | 2/424 |
| 2004/0199982 | A1 | * | 10/2004 | Wang-Lee | 2/424 |
| 2008/0189836 | A1 | * | 8/2008 | Goodhand et al. | 2/424 |
| 2009/0044316 | A1 | * | 2/2009 | Udelhofen | 2/424 |
| 2010/0050326 | A1 | * | 3/2010 | Lee | 2/422 |

FOREIGN PATENT DOCUMENTS

| | | | |
|---|---|---|---|
| JP | 07-003514 | A | 1/1995 |
| JP | 10-298818 | A | 11/1998 |
| KR | 10-1999-0015171 | A | 11/1999 |
| KR | 10-2002-0090634 | A | 12/2002 |
| WO | 8601694 | A1 | 3/1986 |

* cited by examiner

HELMET

TECHNICAL FIELD

The present invention relates to a helmet. More particularly, the present invention relates to a helmet that is designed to have an easily opened and closed face shield installed on a front portion of the helmet and to minimize noise caused by wind resistance.

BACKGROUND ART

When driving or riding a motorcycle or a racing car, a driver or passenger can be protected from an accident by wearing a helmet.

Such a helmet includes a main body that protects a head of a user and a face shield that is installed on a front portion of the main body to protect a viewing field of the user.

The face shield is installed to pivot in a vertical direction of the main body to enhance a ventilation property. A lever is installed at a side of the face shield to facilitate the pivotal motion of the face shield.

The face shield is generally formed of a transparent or translucent synthetic resin. Recently, the face shield has been formed of a material that can screen ultraviolet rays or is colored to block the ultraviolet rays.

However, a helmet that is structured to open and close the face shield using the lever is inconvenient since the user has to ascend and descend the lever by himself/herself.

Furthermore, in the helmet using the lever, since the lever is structured to protrude, noise is considerably generated by wind colliding with the lever during a high speed drive.

The above information disclosed in this Background section is only for enhancement of understanding of the background of the invention and therefore it may contain information that does not form the prior art that is already known in this country to a person of ordinary skill in the art.

BRIEF SUMMARY OF THE INVENTION

Technical Problem

The present invention has been made in an attempt to solve the above problems, and is designed to have an easily openable and closable face shield which protects a face of a user and does not generate any noise that may be caused by a unit for opening and closing the face shield.

Technical Solution

To achieve the objects, the present invention provides a helmet including:

a main body defining a space receiving a head of a wearer;

a holder that is elastically coupled to the main body to be capable of pivoting and has a pushing member;

a shield that is detachably coupled to the holder so that the wearer can securely obtain a viewing field;

a locking/unlocking unit that maintains or releases an open state of the holder when the holder pivots to the open state.

In a state where a catching projection of the holder is inserted and caught, when the locking/unlocking unit of the exemplary embodiment is further pushed, the catching state of the catching projection of the holder is released.

Advantageous Effects

The helmet according to the present invention is designed to easily open and close by simply pushing the face shield upward.

Furthermore, since the face shield is detachably coupled to the holders that are pivotally installed on the main body, the user can select a face shield suiting his/her taste and assemble the selected face shield.

DETAILED DESCRIPTION OF THE INVENTION

The following will describe a best mode that can achieve the technical objects of the present invention.

In the present exemplary embodiment, the reference number 2 indicates a main body of a helmet. The main body 2 defines a space that can receive a head of a user, and the main body 2 is structured to endure an impact applied from an external side. The main body 2 may be formed in a conventional structure.

The main body 2 extends rearward to define a rear surface, thereby protecting top, sides, and rear portions of the head of the user. A face shield 4 is provided on a front portion of the main body 2.

Figure 2:
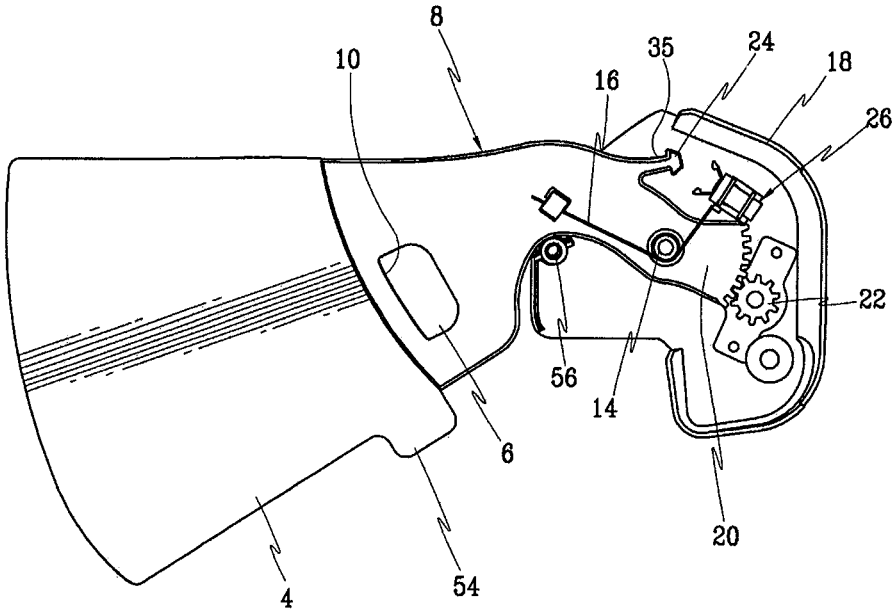
FIG. 2 is a view of a face shield opening/closing unit according to an exemplary embodiment of the present invention, illustrating a closing position of a face shield.
Figure 3:
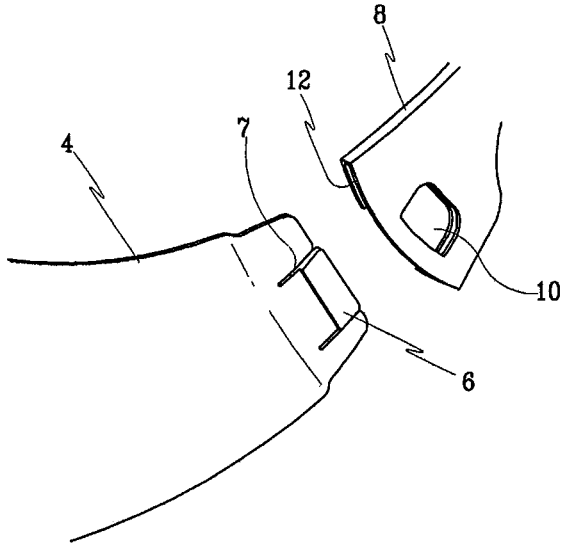
FIG. 3 is a view illustrating a shield coupling structure according to an exemplary embodiment of the present invention.

As shown in FIGS. 2 and 3, the face shield 4 is formed having a predetermined curvature and provided at both sides with respective coupling protrusions 6.

The coupling protrusions 6 protrude from a surface of the face shield 4 and are detachably coupled to holders 8 that are pivotally coupled to the main body 2.

In order to detachably couple the face shield 4 to the holders 8, the holders 8 are provided with coupling holes 10 in which the coupling protrusions 6 are respectively inserted.

Each of the coupling protrusions 6 is designed to be cut at both sides thereof to have an elastic force. Each of the holders 8 to which the coupling protrusions 6 are coupled, is provided with a guide groove 12 in which the shield 4 can be inserted. Therefore, when the shield 4 is inserted in the guide grooves 12, the coupling projections 6 are inserted in the coupling holes 10.

In a state where the shield 4 is coupled to the holders 8, a top portion of the shield 4 and top portions of the holders 8 are positioned in an approximately straight line.

Each of the holders 8 is pivotally coupled to the main body 2 by a hinge pin 14 and installed such that the face shield 4 is biased in a closing direction by a spring 16.

The springs 16 are wound around the hinge pins 14 by at least one turn, in a state of which first and second ends of the springs 16 are respectively fixed on the holders 8 and the main body 2.

The holders 8 achieve the coupling to the main body 2 by being substantially fixed on cover members 18 that are securely fixed on the main body 2.

That is, the holders 8 are pivotally coupled to the cover members 18. Arc-shaped gears 20 are formed on rear ends of the holders 8. The arc-shaped gears 20 are engaged with pinion gears 22 that are rotatably installed on the cover members 18, thereby preventing the holders 8 from quickly moving in an opening/closing direction by the biasing force of the springs 16.

A pushing member 24 protrudes from each holder 8. The pushing state of the pushing members 24 may be maintained or released by stoppers 26 mounted on the cover members 18.

The stoppers 26 are installed on a pivotal motion track of the pushing members 24. The pushing members 24 have a neck portion smaller than a front end thereof.

Figure 4A:
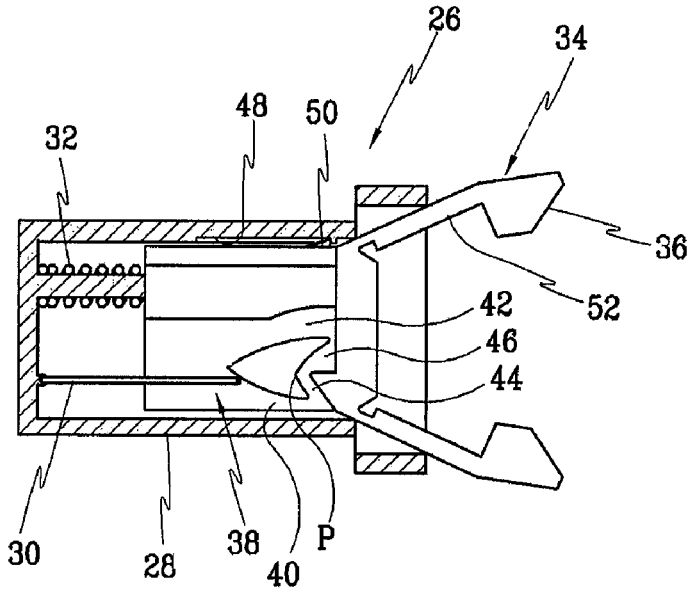
FIGS. 4A and 4B are, respectively, a view illustrating a locking/unlocking unit according to an exemplary embodiment of the present invention.

A conventional one-touch type locking/unlocking mechanism or the like may be used as the stopper 26 of this exemplary embodiment. That is, as shown in FIGS. 4 and 5, each stopper 16 includes a housing 28 fixed on the cover member 18 and a wire member 30 that is bent in a rectangular shape and pivotally coupled inside the housing 28.

A hook member 34 is inserted inside the housing 28 and biased to an external side of the housing by a spring 32.

The hook member 34 includes a pair of folders 36 for fixing or releasing the pushing member 24. The folders 36 are integrally formed with a locking/unlocking unit 38.

The locking/unlocking unit 38 has passages 40 and 42 through which open ends 31 and 33 of the wire member 30 can pass. The passages 40 and 42 communicate with each other by inclined grooves 44 and 46 that are inclined in opposite directions.

The passages 40 and 42 and the inclined grooves 44 and 46 are identically or similarly formed on front and rear surfaces of a main body of the hook member 34 so that the open ends 31 and 33 of the wire member 30 can be respectively located on the passages formed on the front and rear surfaces.

The locking/unlocking unit 38 of this exemplary embodiment is illustrated by way of example. Therefore, the present invention is not limited to this exemplary embodiment. That is, other similar one-touch type mechanisms may be used as the locking/unlocking unit 38.

The open ends 31 and 33 of the wire member 30 are respectively located contacting the front and rear surfaces of the hook member 34. The housing 28 is provided at an inside with a groove 48 in which a protrusion 50 of the hook member 34 is inserted. Therefore, although the hook member 34 is biased by the spring 32, the hook member 34 is not separated from the housing 28.

The pair of folders 36 has arm portions 52 each having an elastic force. Therefore, when the folders 36 move out of the housing 28, they are widened from each other. When the folders 36 move inside the housing 28, the folders 36 move close to each other.

Therefore, when the pushing member 24 pushes the hook member 34, the hook member 34 moves into the housing 28. At this point, the folders 36 move close to each other, by which the pushing member 24 is clamped by the folders 36.

A pressing portion 54 is formed protruding from a lower end of the face shield so that the face shield 4 can move upward by the user pushing the pressing portion 54. The cover member 18 is provided with a protrusion 56 restricting the pivotal motion of the holder 8.

Figure 1:
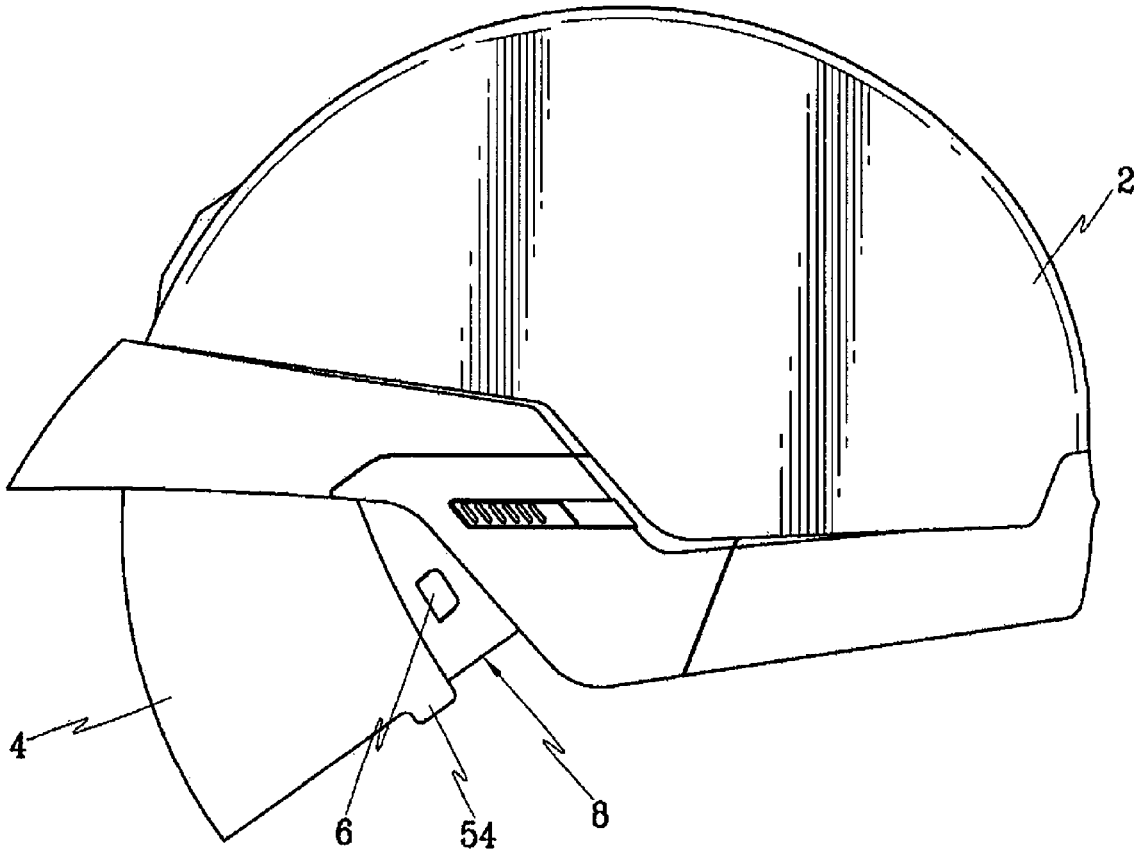
FIG. 1 is a side view of a helmet according to an exemplary embodiment of the present invention.

According to the helmet structure as described, the face shield 4 is installed on the front portion of the main body 2. In FIG. 1, the face shield 4 is in a closed state.

In the closed state of the face shield 4 as shown in FIG. 1, the pinion gear 22 is engaged with a lower end of the arc-shaped gear 20 of the holder 8, as shown in FIG. 2.

In the state of FIG. 2, the pushing member 24 formed on the holder 8 is separated from the stopper 26 and biased by the spring 16 counterclockwise in FIG. 2.

In this state, the face shield 4 cannot rotate counterclockwise anymore by the protrusion 56.

In this state, when the user pushes the shield 4 upward, the holder 8 pivots clockwise about the hinge pin 14.

At this point, the pushing member 24 moves toward the housing 28 of the stopper 26 and contacts the pair of the folders 36, in the course of which the pushing member 24 pushes the hook member 34.

By the above operation, the hook member 34 moves toward the housing 28 while compressing the spring 32.

Figure 8:
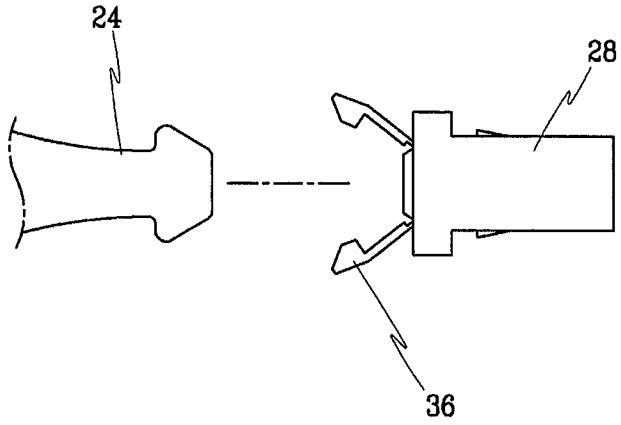
FIG. 8 is a view illustrating a state before a stopper related to the present invention is coupled.
Figure 9:
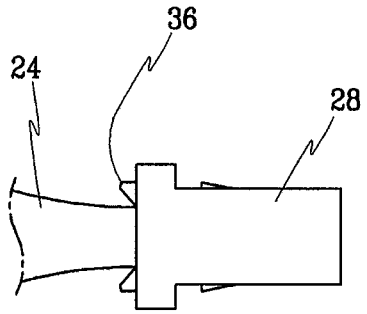
FIG. 9 is a view illustrating a state after the stopper related to the present invention is coupled.

At this point, the pair of folders 36 move toward each other while advancing into the housing 28. Since the pushing member 24 is provided with the neck portion 35 smaller than the front end, the neck portion 35 is fixed by being enclosed by the folders 36 moving toward each other. The state shown in FIG. 8 changes to the state shown in FIG. 9.

At the same time, when the hook member 34 moves inside the housing 28, the front end of the wire member 30 installed in the housing 28 reaches the inclined groove 46 while advancing toward the passage 40 of the hook member 34.

Figure 4B:
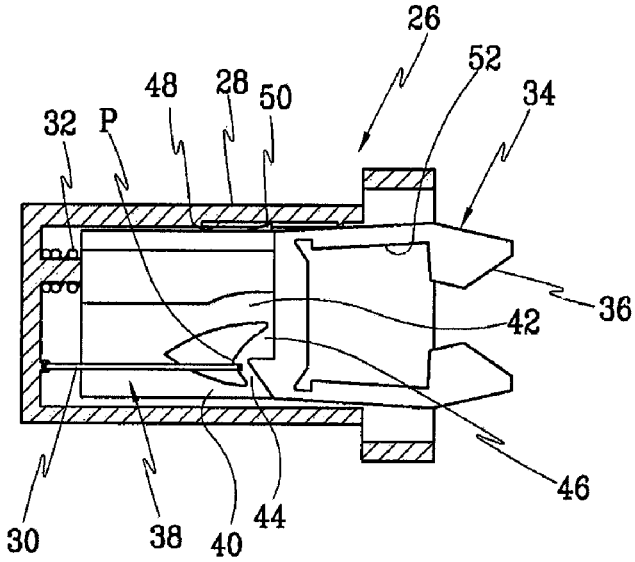
Figure 5:
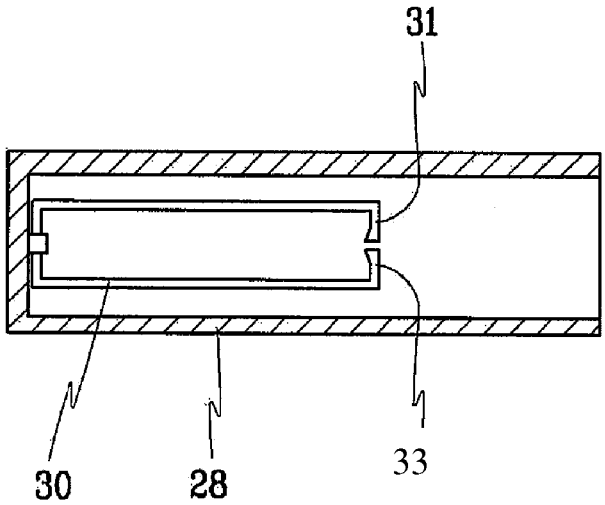
FIG. 5 is a view illustrating a wire member installing structure related to the present invention.

When the shield 4 is not pushed anymore during the above process, the front end of the wire member 30 is hooked on a point P where the inclined groove 44 is connected to another inclined groove 46 (see FIG. 4B).

The point P is formed in a V-shape so that the front end of the wire member 30 can be hooked therein.

Figure 6:
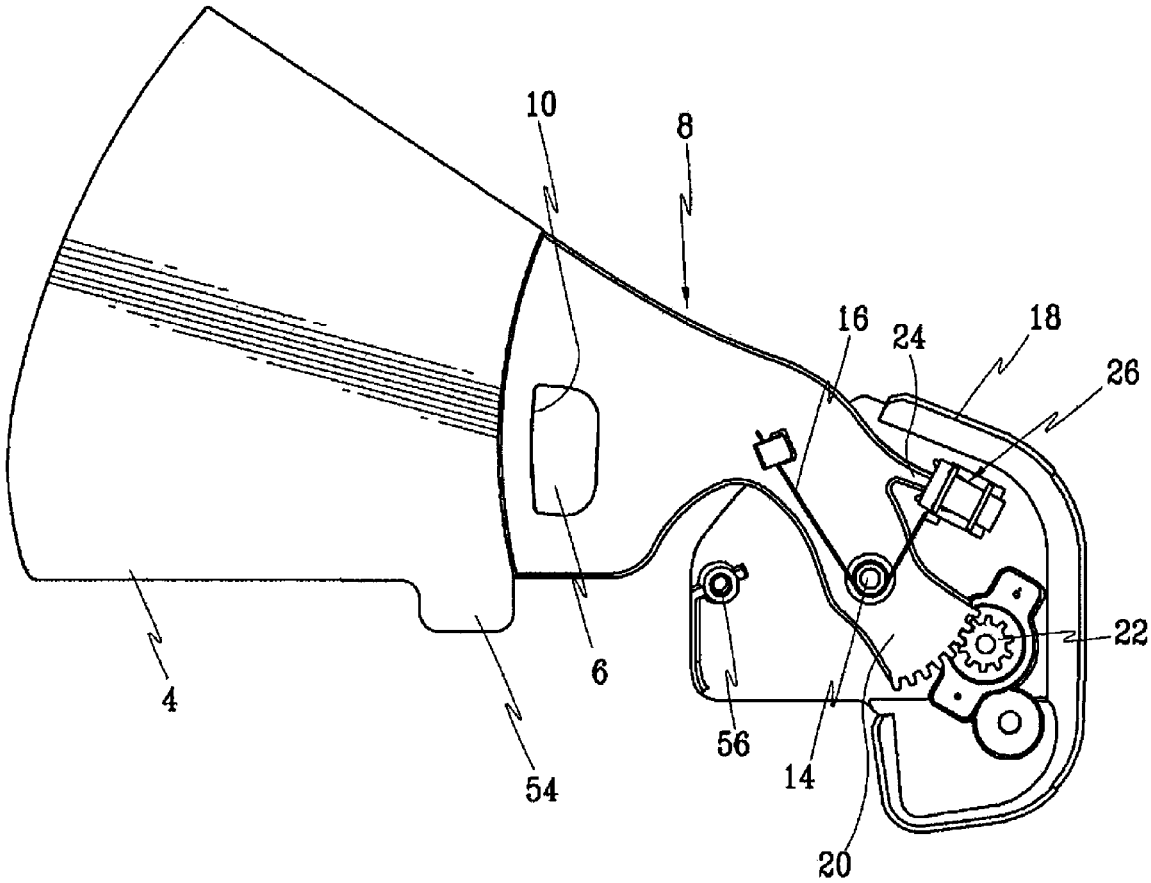
FIG. 6 is a view of the shield opening/closing unit according to an embodiment of the present invention illustrating a shield open state.
Figure 7:
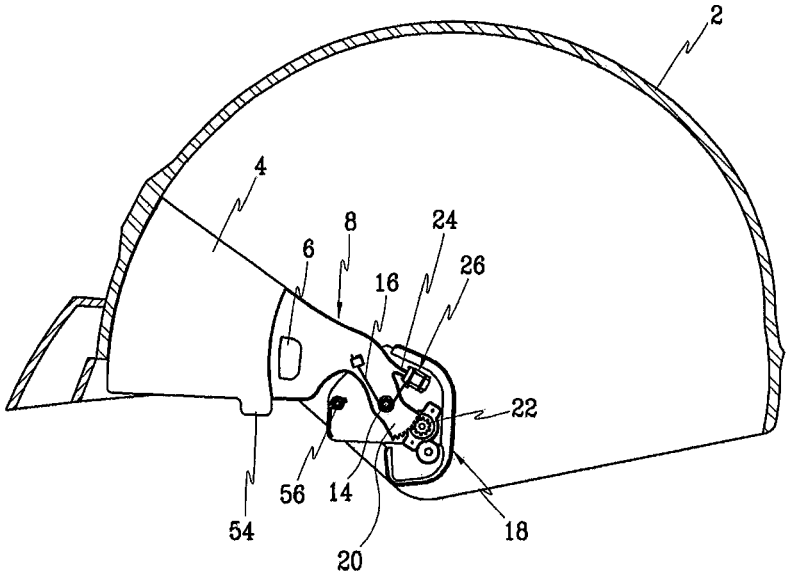
FIG. 7 is a view illustrating a state where the shield opening/closing unit is applied to a main body of the helmet according to an exemplary embodiment of the present invention.

Then, as shown in FIGS. 6 and 7, the shield 4 maintains the opened state.

In this state where the shield 4 is opened, when the shield 4 is pushed upward, the front end of the wire member 30, which is located between the inclined grooves 44 and 46, moves toward the passage 42 while advancing toward the inclined groove 46.

In this state where the shield 4 is opened, when the shield 4 is pushed upward, the front end of the wire member 3, which is located between the inclined grooves 44 and 46, moves toward the passage 42 while advancing toward the inclined groove 46.

In this state, when the shield 4 is not pushed, the hook member 34 is pushed out of the housing 28 by the biasing force of the spring 32.

Therefore, the folders 36 catching the pushing member 24 move away from each other to release the pushing member 24 and thus the pushing member 24 moves the shield 4 to the closed position as the holder 8 rotates counterclockwise by the biasing force of the spring 16.

When the face shield 4 is pushed upward as described above, the face shield 4 maintains the open state. When the face shield 4 is further pushed upward, the shield 4 is closed.

At this point, a pressing portion 54 is provided to effectively push the face shield 4 upward. The pressing portion 54 is effective when the face shield 4 is pushed upward in a state where it is opened as shown in FIG. 7.

According to the helmet of the exemplary embodiment, the face shield may be selected in accordance with a color, a shape, and the like, and a combination thereof.

FIG. 3 shows a coupling unit of the shield. The coupling projections 6 formed on the left and right ends of the face shield 4 have an elastic force by the cutting lines 7. Therefore, when the coupling projections 6 are pushed into the guide grooves 12 formed on the holders 8, the coupling projections 6 are fixed in the coupling holes 10.

In this state, when the face shield 4 is pulled after the coupling projections 6 are pressed, the face shield 4 is separated from the holders 8. Therefore, the face shield 4 can be easily replaced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

INDUSTRIAL APPLICABILITY

The helmet according to the exemplary embodiment of the present invention can be used by a motorcycle driver or a racing car driver. Therefore, the present invention can be applied in a helmet manufacturing field industry.

What is claimed is:

1. A helmet comprising:

a main body defining a space adapted to receive a head of a wearer;

a holder that is elastically coupled to the main body to be capable of pivoting and has a pushing member; and a face shield that is detachably coupled to the holder so that the wearer can securely obtain a viewing field; and a stopper that maintains or releases an open state of the holder when the holder pivots to the open state, wherein the stopper comprises:

a housing;

a hook member that is elastically installed inside the housing and has a pair of folders; and a locking/unlocking unit for moving the folders of the hook member into the housing or out of the housing an elastic force, wherein the locking/unlocking unit comprises:

a wire member that is pivotally installed in the housing;

two passages that are formed on the hook member, the wire member to be disposed and advanced along the passages; and two inclined grooves that are formed between the passages, connected to the passages, and inclined in an opposite direction to each other, wherein the locking/unlocking unit defines a recessed point where the inclined grooves meet so that a front end of the wire member is hooked in the recessed point to hold the holder in the open state.

2. The helmet of claim 1, wherein coupling protrusions are elastically formed on both side ends of the face shield and are capable of being coupled to respective coupling holes formed in the holder.

3. The helmet of claim 1, wherein the holder is elastically coupled to the main body to be capable of pivoting and provided at a rear end with an arc-shaped gear.

4. The helmet of claim 3, wherein the arc-shaped gear is engaged with a pinion gear to reduce a pivot speed when the holder pivots to a closed state.

5. The helmet of claim 1, wherein the holder is provided with a guide groove for fixing the face shield.

6. The helmet of claim 1, wherein the face shield is provided at a lower end with a pressing portion for pushing the face shield upward.

7. The helmet of claim 1, wherein the pushing member is provided with a neck portion smaller than a front end thereof.

* * * * *